United States Patent [19]

Pinnock et al.

[11] 4,192,458

[45] Mar. 11, 1980

[54] FIREPLACE LINER

[76] Inventors: Jay L. Pinnock, 2727 Airport Rd.; Ivan C. Staten, 20 Century Cir., both of Carson City, Nev. 89701

[21] Appl. No.: 877,142

[22] Filed: Feb. 13, 1978

[51] Int. Cl.[2] ..... F24B 1/18

[52] U.S. Cl. ..... 237/51; 126/121; 236/93 R; 165/39

[58] Field of Search ..... 237/51; 126/121; 236/10, 101 D, 93 R; 165/39

[56] References Cited

U.S. PATENT DOCUMENTS

| | | | |
|---|---|---|---|
| 1,697,635 | 1/1929 | Cornelius | 126/121 |
| 2,292,082 | 8/1942 | Miller | 236/10 |
| 2,322,016 | 6/1943 | Hardeman | 237/51 |
| 3,368,756 | 2/1968 | Edwards | 236/49 |
| 3,937,168 | 2/1976 | Doak | 137/527.8 X |
| 3,999,535 | 12/1976 | Hall | 126/121 |
| 4,004,731 | 1/1977 | Zung | 126/121 X |

*Primary Examiner*—William E. Wayner
*Assistant Examiner*—William E. Tapolcai, Jr.

[57] ABSTRACT

An improved fireplace liner of the type in which air is drawn in to a heat exchange chamber to be heated before passing into the room in which the fireplace is located. A movable closure device is located between the heat exchange chamber and the outside environment. A thermally-responsive spiral-shaped member, connected to the closure device and to the heat exchange chamber, coils or winds up to open the closure device when heat is applied to the fireplace. The opening of the closure device permits the entrance of outside air into the heat exchange chamber for heating by the fireplace. The thermally-responsive member unwinds or relaxes when heat is removed from the fireplace, allowing the closure device to return to its closed position, thus preventing the introduction of outside air.

2 Claims, 2 Drawing Figures

FIREPLACE LINER

BACKGROUND OF THE INVENTION

The present invention relates to an improved fireplace liner of the type in which air is heated in a heat exchange chamber and then circulated throughout the room. More specifically, the improvement comprises a thermally responsive closure device which permits entry of outside air into the heat exchange chamber for heating prior to subsequent passage out into the room.

Ordinary fireplace liners consist of a firebox connected to a flue and a heat exchange chamber located behind the firebox. The heat exchange chamber has air inlet openings at the base of the fireplace, generally near the floor, and outlet vents generally located above the fireplace. In operation, room air is brought into the lower openings, is heated by conduction within the chamber and is then passed through the outlet vents and back into the room. The heat exchange chamber is completely sealed from the firebox and flue to avoid mixing room air with the gaseous products of combustion.

Ordinary fireplace liners possess inherent disadvantages. For example, since the fire requires oxygen, the typical fireplace liner will function properly only when the room or house is improperly sealed from the outside environment. As the fire burns, make-up air is drawn in from the outside, generally through cracks around the doors and windows. The passage of air from the outside through these cracks creates localized cold air drafts which can be both annoying and unhealthy to room occupants. Additionally, if a house is too tightly sealed, the fire burns incompletely, resulting in partially burned logs. Furthermore, if there is no adequate supply of fresh air because of the tight seal, the removal of oxygen from the room often results in a feeling of drowsiness by occupants of the room.

In those fireplace liners which have means for bringing outside air into the heat exchange chamber, there exist various types of closure devices which block the access to the outside when the fireplace is not in use. These devices are activated either manually or electrically. Thus, when a fire is started in a fireplace, one must wait until it is sufficiently hot and then must either manually open the access to the outside or activate an electrical switch which then opens the closure device. Quite frequently, one forgets to open the closure device, and in such an instance the fireplace liner does not even operate as an ordinary liner. Rather, the fireplace functions strictly in the conventional sense. That is, there is neither recirculation of room air, nor circulation of outside fresh air within the room.

The present invention solves the inherent problems of ordinary fireplace liners as well as the specific problems existing in those fireplace liners which utilize outside air. The invention provides for automatic opening of the access to the outside when the fire within the firebox reaches a predetermined temperature. When the fireplace cools, the closure device returns to its normally closed position, thus blocking the entrance of outside cold air. U.S. Pat. No. 3,134,377 discloses a thermally responsive vent, located within a flue damper, which automatically closes and blocks access to the flue when the fire within the fireplace has gone out.

SUMMARY OF THE INVENTION

The present invention relates to an improvement in fireplace liners of the type in which air is circulated through a heat exchange chamber. The improvement generally comprises a means for automatically opening and closing an access for the entrance of outside air into the heat exchange chamber.

In this improved fireplace liner, a duct connects the heat exchange chamber with the outside environment. If the fireplace is located next to an outside room wall, this duct is necessarily very short. Because the heat exchange chamber has outlet vents which are directly open to the inside of the room, cold outside air will enter the room unless otherwise blocked. Located within the duct is a movable plate or closure device which is in the closed or blocked position when there is no fire within the fireplace. Thus, in the absence of a fire in the fireplace, cold outside air is blocked from entering the warm room.

The closure device within the duct comprises generally a plate of essentially the same shape as the cross-sectional shape of the duct. The plate is mounted within the duct by a pivoting mechanism located along an axis displaced above the central axis of the plate. Because a major weight portion of the plate is on one side of this line, ie, the portion of the plate below the axis is heavier, the plate will normally reside in a generally vertical or closed position due to the effect of gravity.

An automatic opening mechanism is connected to the heat exchange chamber and arranged to contact the lower portion of the plate. Preferably this mechanism is a bimetallic strip which is temperature responsive. In particular the strip is wound into a spiral or coil shape and when heated to a predetermined temperature winds up into a tighter spiral. Also located within the duct or in the general vicinity of the heat exchange chamber is a fan which forces outside air into the heat exchange chamber and out into the room when the closure device is in the open position.

In operation, the closure plate is in the closed or blocked position when a fire is first started in the fireplace. As the fire continues to burn, the heat exchange chamber becomes hot and conducts heat to the bimetallic coil. As the coil warms, it winds up, causing the closure plate to open, thereby permitting the entrance of outside air. The natural convection of heated air draws outside cold air in through the duct for heating and passage out through upper outlet vents into the room. In a preferred embodiment, the electric fan may be turned on to assist in forcing outside air into the heat exchange chamber for heating prior to passage into the room. When the fire dies down, the bimetallic coil will cool and expand its spiral shape or unwind, to allow the gravity return of the closure place to its closed position, since the plate is pivotable about an off-centered axis.

Thus, the present invention provides a continuous supply of fresh air into the room without reliance upon cracks around doors and windows. Because a continuous supply of fresh oxygen reaches the room, the fire burns completely. Cold air drafts and drowsiness of the occupants are prevented. By heating outside air and circulating it throughout the house, the fireplace serves a utilitarian purpose as well as an asthetic purpose. Thus, energy is conserved and less fuel need be burned to heat the house. Because the invention is directed to a closure device which opens automatically, the fireplace liner is not dependent upon human intervention to operate properly. Whenever a fire is started within the fireplace, the fireplace liner will function as designed, namely to bring outside air into a heat exchange chamber for heating prior to passage into the room. Unlike prior art fireplace liners, one need not remember specifically to open a closure device after a fire is started. Nor need one remember to close the closure device to prevent the flow of hot air out of the house after the fire has gone out.

The novel features which are believed to be characteristic of the invention, together with further objects and advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
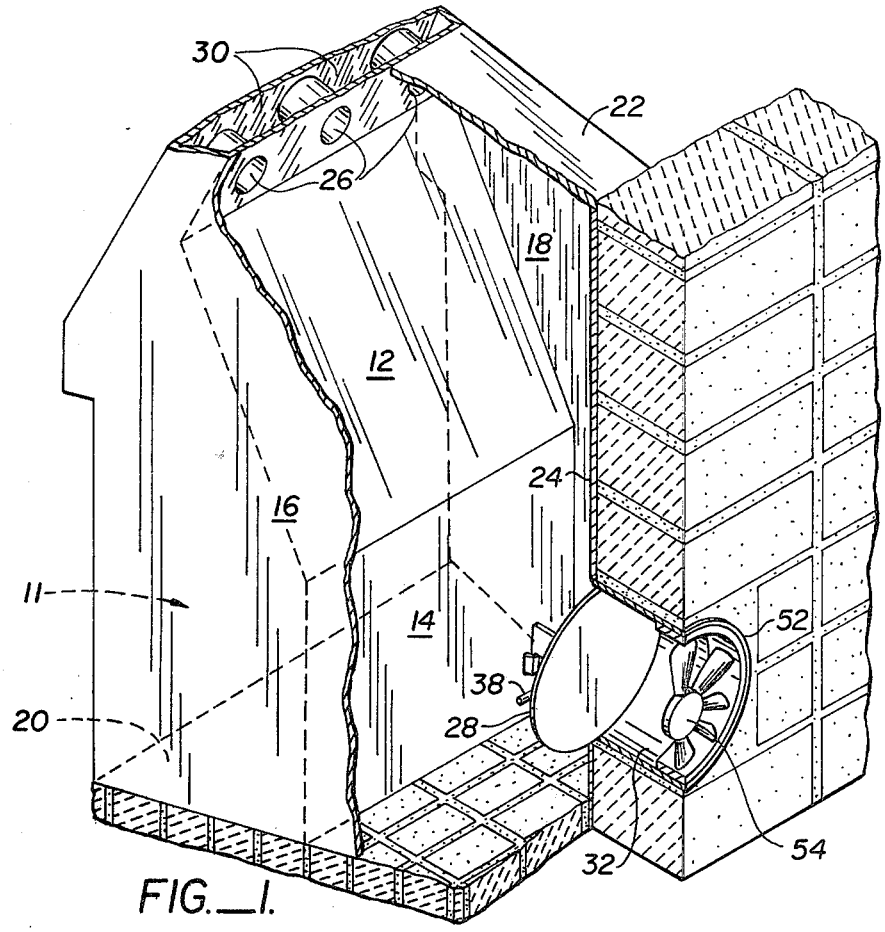
FIG. 1 is a cutaway view illustrating the fireplace liner installed adjacent an exterior wall.

The fireplace liner comprises generally two major portions, as illustrated in FIG. 1. The first major portion is the firebox 11 which is generally that interior portion of the liner bounded by walls, 12, 14, 16, 18 and firebox floor 20. The firebox floor 20 is that surface where the fire is constructed and burns, and is generally composed of firebrick layed with high temperature mortar. The second major portion of the fireplace liner is the heat exchange chamber. In FIG. 1, the heat exchange chamber is an enclosed structure bounded essentially by surfaces 12 and 18, mortar shelf 22, shown in cutaway, rear wall 24, and extended side walls 16 and 18. It is to be especially noted that FIG. 1 is a cutaway view of the fireplace liner and that the heat exchange chamber forms a completely enclosed volume.

The heat exchange chamber has outlet vents 26 which connect it to the inside of the room in which the fireplace is located. At the lower portion of the heat exchange chamber is the air inlet opening which contains the movable closure device or plate 28.

Referring now to FIG. 1 and bearing in mind the two major portions of the fireplace liner, specifically the firebox portion and the heat exchange chamber, it will be observed that there are two separate paths of airflow. First, when a fire is burning within the firebox, oxygen is drawn into the fire from within the room and the gaseous products of combustion pass up the firebox, through passages 30, and up the flue, which is located above mortar shelf 22 and adjacent the exterior wall of the building. When the closure plate 28 is in the open position, the second and separate path of airflow is from the outside environment, through duct 32, into the heat exchange chamber, and out through vents 26. Such a construction of the fireplace liner thus prevents any mixing of outside fresh air with the products of combustion.

Figure 2:
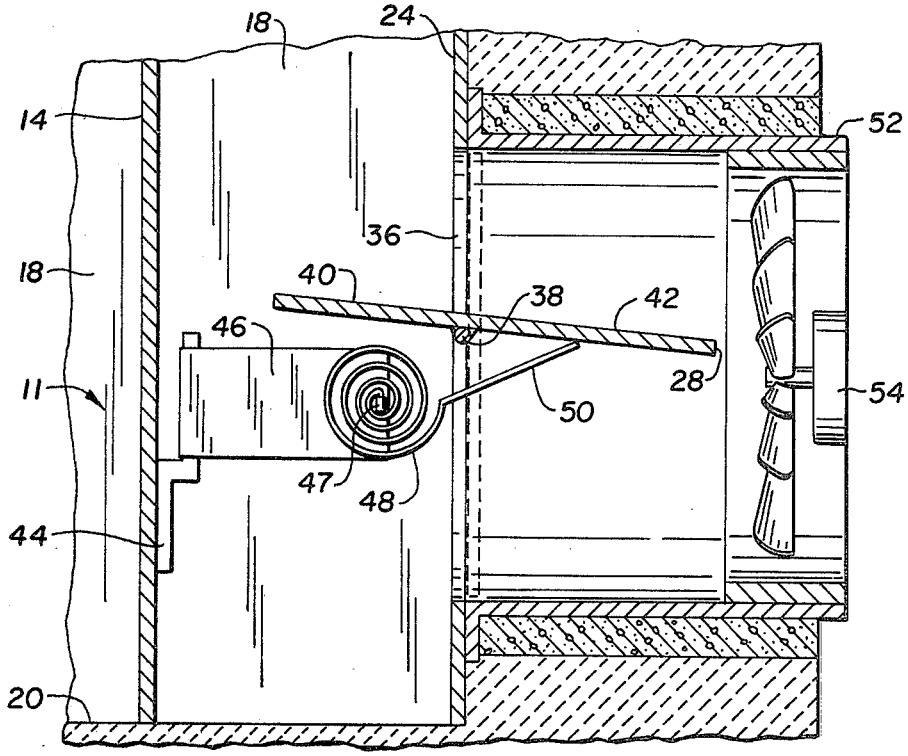
FIG. 2 is a cross sectional view of the closure device and the opening connecting the fireplace liner to the outside environment.

Referring now to FIG. 2, the construction and operation of the automatic closure device will be more fully understood. A circular opening 36 is cut into the exterior wall 24 of the heat exchange chamber. The closure plate 28, of generally the same shape as the opening 36, is located within the opening and connected thereto by an axle 38. Axle 38 is connected to the plate 28 by welding or other suitable means and generally separates the plate into a smaller upper portion 40 and a substantially larger lower portion 42. The axle 38 is inserted into notches or cut outs in the wall 24 at opposite sides of the opening 36. Alternatively, the axle 38 may be journalled at its opposite ends.

Connected to the interior wall 14 of the heat exchange chamber by suitable mounting brackets 44 and 46 is a bimetallic thermally responsive strip 48 wound into a spiral. The bimetallic strip comprises two different metals of different coefficients of thermal expansion bonded together. In response to an increase in temperature, the strip deforms due to the greater expansion of one of the metals. In the preferred embodiment the outer metal expands to a greater extent than the inner metal, so that the spiral tightens or winds up in response to an increase in temperature. The inner tip 47 of the bimetallic spiral is rigidly secured, such as by welding, to the bracket 46. The brackets 44 and 46 are both thermally conductive. The outer end of the bimetallic spiral is a generally straight portion 50 which merely contacts the lower portion 42 of the cover plate.

Connected to the exterior wall 24 of the heat exchange chamber is a duct 52 which provides direct access of outside air into the heat exchange chamber. Located within the duct and preferably close to the exterior surface of the building is a fan 54. The fan 54 is electrically operated to force outside air through the duct 52 into the heat exchange chamber for heating prior to its passage through vents 26 and into the room.

The invention as thus described can be better understood by considering the operation of its component parts when a fire is started in the firebox portion of the fireplace. When there is no fire in the firebox, the interior wall 14 of the heat exchange chamber, brackets 44 and 46, and bimetallic spiral 48 are generally at room temperature or less and the bimetallic spiral is unwound or relaxed. When the spiral is relaxed it will be noted that the cover plate 28 is in a vertical position, as shown by the dotted lines in FIG. 2, and is thus blocking the access to the outside environment. The cover plate 28 is retained in such a vertical or closed position by the action of gravity since the axle 38 is connected to the plate along a line above the central axis of the plate. After the fire is started in the firebox and continues to burn at an increasing rate, heat from the fire is radiated to the wall 14 and conducted through the wall 14 and brackets 44 and 46 to the bimetallic spiral 48. When the bimetallic spiral reaches a predetermined temperature, dependent upon the choice of metals used in constructing the spiral, the spiral begins to wind up. It should be noted at this point that while in the preferred embodiment the spiral contracts in response to an increase in temperature, a bimetallic spiral which expands in response to an increase in temperature may be mounted on the bracket 46 in such a manner as to effect the same result; namely the opening of the cover plate when a fire is present in the firebox. The winding up of the spiral moves the longitudinal portion 50 upward, thus raising the lower portion 42 of the cover plate and allowing access for outside air through the duct and into the heat exchange chamber. The cover plate 28 is shown in its open position in FIG. 2.

Because of the convective effect of hot air, cold air is naturally brought in through the duct 52 and into the heat exchange chamber where it is heated by the hot walls of the heat exchange chamber. As the air is heated it rises to the upper portion of the heat exchange chamber, out through vents 26, and into the room. When air begins to enter the room, the electric fan may be turned on, if desired, to assist in forcing the air through the duct and into the heat exchange chamber.

When the fire is put out or dies out of its own accord, the temperature of the wall 14 correspondingly decreases. The bimetallic spiral similarly cools and thus relaxes or unwinds, lowering longitudinal member 50. As the spiral unwinds the force of gravity returns the cover plate once again to its closed position, as shown by the dotted lines in FIG. 2, thus blocking the exit of warm room air. The electric fan, if it was turned on to assist in forcing the air into the heat exchange chamber when the fire was burning, may now be turned off.

While the preferred embodiment of the invention has been illustrated in detail, it is apparent that modifications and adaptations of that embodiment will occur to those skilled in the art. However, it is to be expressly understood that such modifications and adaptations are within the sphere and scope of the present invention.

I claim:

1. An improved room heating combination of a fireplace and a liner therefor and a heat exchange chamber surrounding the fireplace from which heated air resulting from combustion is directed through a heat conveying passage into the room to be heated and wherein the heat conveying passage is connected from the heat exchanger chamber of the fireplace into which passage a connecting means is supplied to introduce also fresh unheated outer air from an external source to be heated and introduced into the room from the fireplace unit so that outside air may be heated prior to being circulated and supplied to the room, comprising, in combination, an inlet duct for supplying fresh air from a region external to the heat exchanger chamber to be heated by the fireplace;

an outlet passage for supplying said heated outside air at controlled temperature into the region of the room;

means in the inlet duct to provide a propellant force to the intake air to direct it into the heat exchanger chamber;

a closure member within the inlet duct having a peripheral configuration and transverse size substantially corresponding to that of the interior of the inlet duct, thereby to substantially close the duct when transversely positioned thereto;

means for positioning the said closure member for pivotal movement thereof within the duct and between an open and a closed position relative to the duct by the pivotal movement thereof within the said duct, the pivot axis upon which said pivotal movement may be caused to occur being along an axis transverse to the duct length such that the closure member is divided into two unequal area parts and whereby the said member if unactivated will tend to close within the duct and whereby said member may be pivoted between an open and a closed position and when in a closed state of rest will interrupt air passage within the duct and when pivoted to a controlled open position will permit passage of controlled volumes of air through the duct and in a median position will determine the maximum air quantity passing therethrough;

a fixed position temperature control means within the passage for establishing the temperature of air passing beyond the region of the heat exchanger chamber and the region between said heat exchanger chamber and the outlet from the air supply to mingle therewith, and means for controlling the instantaneous position of the closure member from the said control means comprising an arm member extending from the temperature control and sensing means toward the closure member and in frictional contact engagement with the said latter member at a region within its greater area portion to move the closure member to an open position with heat increases within the heat exchanger member, thereby to admit greater air quantities thereto and to provide means to remove the frictional stress on the said closure member with temperature decreases to permit gravitational closure of the said closure member and to provide stabilized and resulting temperature control of the air supply from the fireplace to the room.

2. The combination claimed in claim 1 wherein the temperature control means includes a bimetallic coiled strip having the interior of the said coil anchored in the region where air from the heat exchanger chamber and inlet air are mingled and wherein the arm member is connected at one of its ends to the free end of the coil and the other arm end is movably rested upon the closure member for frictionally controlling its movement.

* * * * *